US005370303A

United States Patent [19]

Fry

[11] Patent Number: 5,370,303

[45] Date of Patent: Dec. 6, 1994

[54] ONE PIECE GRAPE BOX

[75] Inventor: Stanley L. Fry, West Covina, Calif.

[73] Assignee: International Paper Co., Purchase, N.Y.

[21] Appl. No.: 202,246

[22] Filed: Feb. 25, 1994

Related U.S. Application Data

[63] Continuation of Ser. No. 46,357, Apr. 14, 1993.

[51] Int. Cl.[5] ..... B65D 5/06

[52] U.S. Cl. ..... 229/143; 206/509; 229/191; 229/918; 229/919

[58] Field of Search ..... 229/915, 919, DIG. 11, 229/DIG. 1, 120, 143, 149, 156, 157, 918, 191; 206/508, 509, 510, 513

[56] References Cited

U.S. PATENT DOCUMENTS

| | | | |
|---|---|---|---|
| 2,766,923 | 10/1956 | D'Esposito . | |
| 3,079,058 | 2/1963 | Russell | 229/919 X |
| 3,397,831 | 8/1968 | Adams . | |
| 3,820,706 | 6/1974 | Gibson et al. . | |
| 4,056,223 | 11/1977 | Williams . | |
| 4,129,247 | 12/1978 | McCall . | |
| 4,139,146 | 2/1979 | Bamburg et al. | 229/919 X |
| 4,154,388 | 5/1979 | Hall | 229/919 X |
| 4,165,031 | 8/1979 | Osborne | 229/919 X |
| 4,218,009 | 8/1980 | Don Carlos | 229/156 |
| 4,236,740 | 12/1980 | Sorenson et al. | 229/143 |
| 4,304,351 | 12/1981 | Stollberg | 229/143 X |
| 4,497,408 | 2/1985 | Jes . | |
| 4,645,122 | 2/1987 | Nederveld . | |
| 4,770,339 | 9/1988 | Weiner | 229/DIG. 11 |
| 4,884,739 | 12/1989 | Nederveld | 229/120 X |
| 5,000,377 | 3/1991 | McClure | 229/919 X |
| 5,002,224 | 3/1991 | Muise | 229/DIG. 11 |
| 5,261,594 | 11/1993 | Brown et al. | 229/919 X |

*Primary Examiner*—Allan N. Shoap
*Assistant Examiner*—Christopher McDonald
*Attorney, Agent, or Firm*—Michael J. Doyle; Paul R. Juhasz

[57] ABSTRACT

A one piece container, particularly adapted for the packaging of grapes and fashioned of corrugated paperboard, exhibits three thicknesses of paperboard over the major extent of its end walls. Each of two top closure panels is provided with latching tongues for insertion into slots in respective upstanding ears at each end wall. The upstanding ears are adapted to fit in complementary recesses in the bottom of a similar container stacked thereon. Vertically extending channels are located at respective corners of the container for stacking strength.

9 Claims, 3 Drawing Sheets

FIG. 3
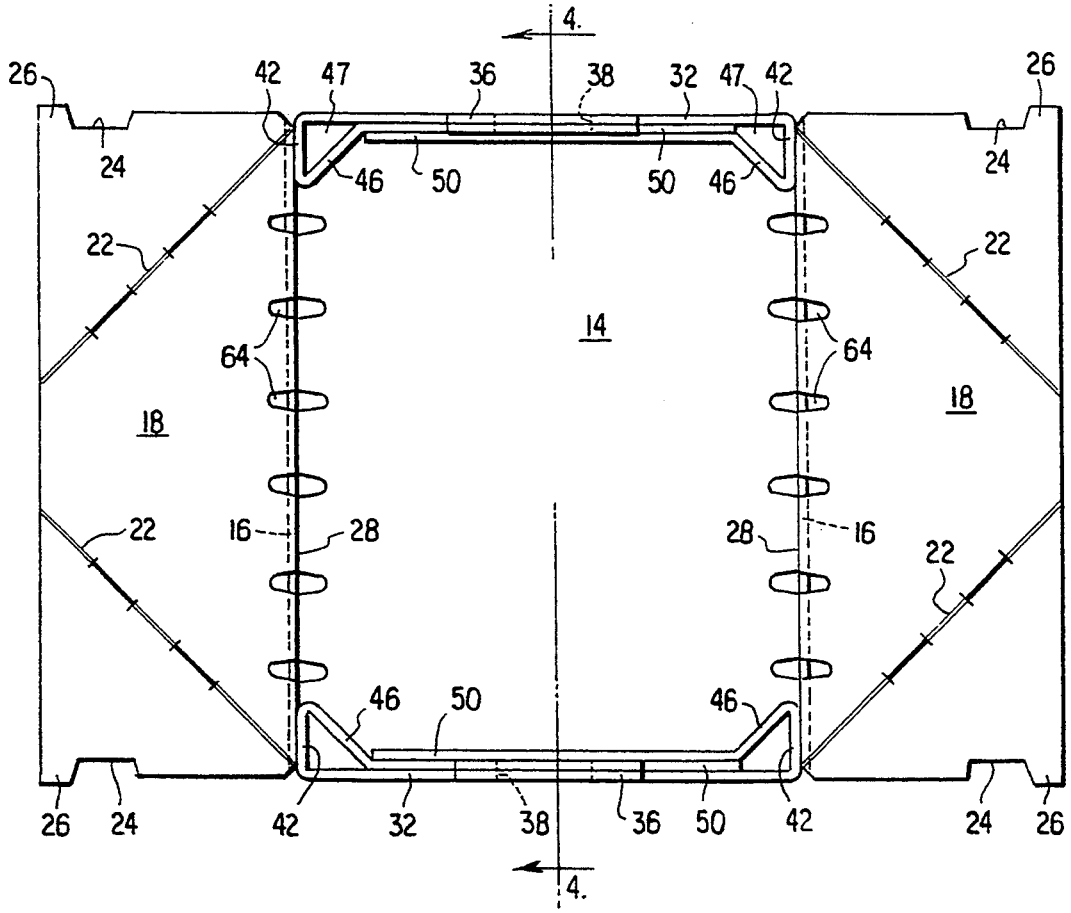
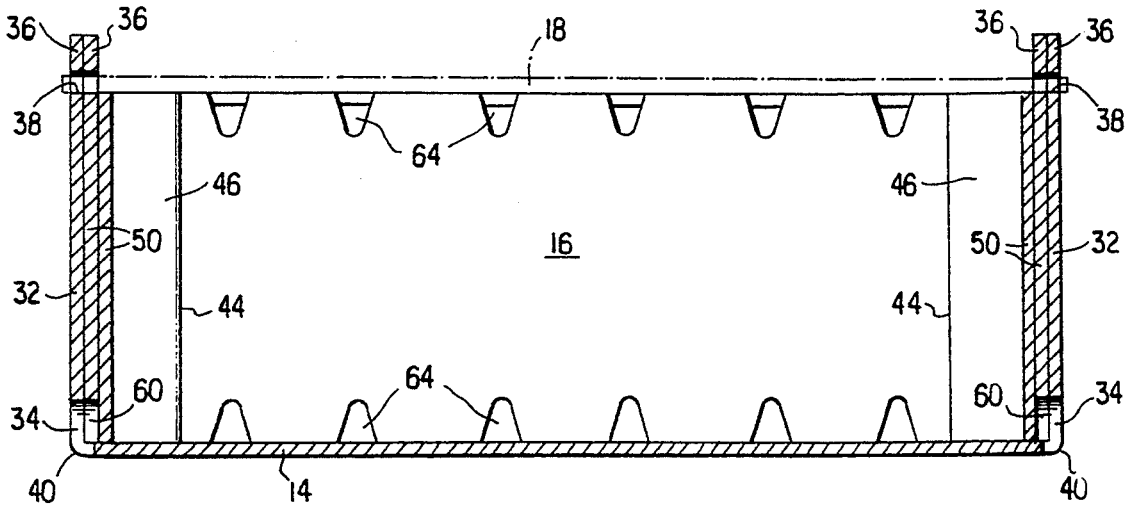
FIG. 4

ONE PIECE GRAPE BOX

This application is a continuation of application Ser. No. 08/046357 filed Apr. 14, 1993.

BACKGROUND OF THE INVENTION

This invention relates to containers fashioned from corrugated paperboard and more particularly to a container fashioned from a unitary blank of corrugated paperboard end particularly adapted to hold grapes. The containers are usually stacked during shipment and hence must exhibit significant edge load strength. Containers of this general configuration and formed from a unitary blank are shown in U.S. Pat. Nos. 1,207,899 issued to Greve and 4,056,223 issued to Williams.

SUMMARY OF THE INVENTION

According to the practice of this invention, a one piece container, particularly adapted for the packaging of grapes and fashioned of corrugated paperboard, exhibits three thicknesses of paperboard over the entire extent of its end walls. Each of two top closure panels is provided with latching tongues for insertion into slots in respective upstanding ears at each end wall. The upstanding ears are adapted to fit in complementary recesses in the bottom of a similar container stacked thereon. Vertically extending channels are located at respective corners of the container for stacking strength. The panels which define the end walls are typically glued together to increase vertically downward edge loading strength.

BRIEF DESCRIPTION OF THE DRAWINGS

FIG. 3 is a top plan view of the container showing the top flaps open.

FIG. 4 is taken along section 4—4 of FIG. 3.

DETAILED DESCRIPTION OF THE INVENTION

Figure 1:
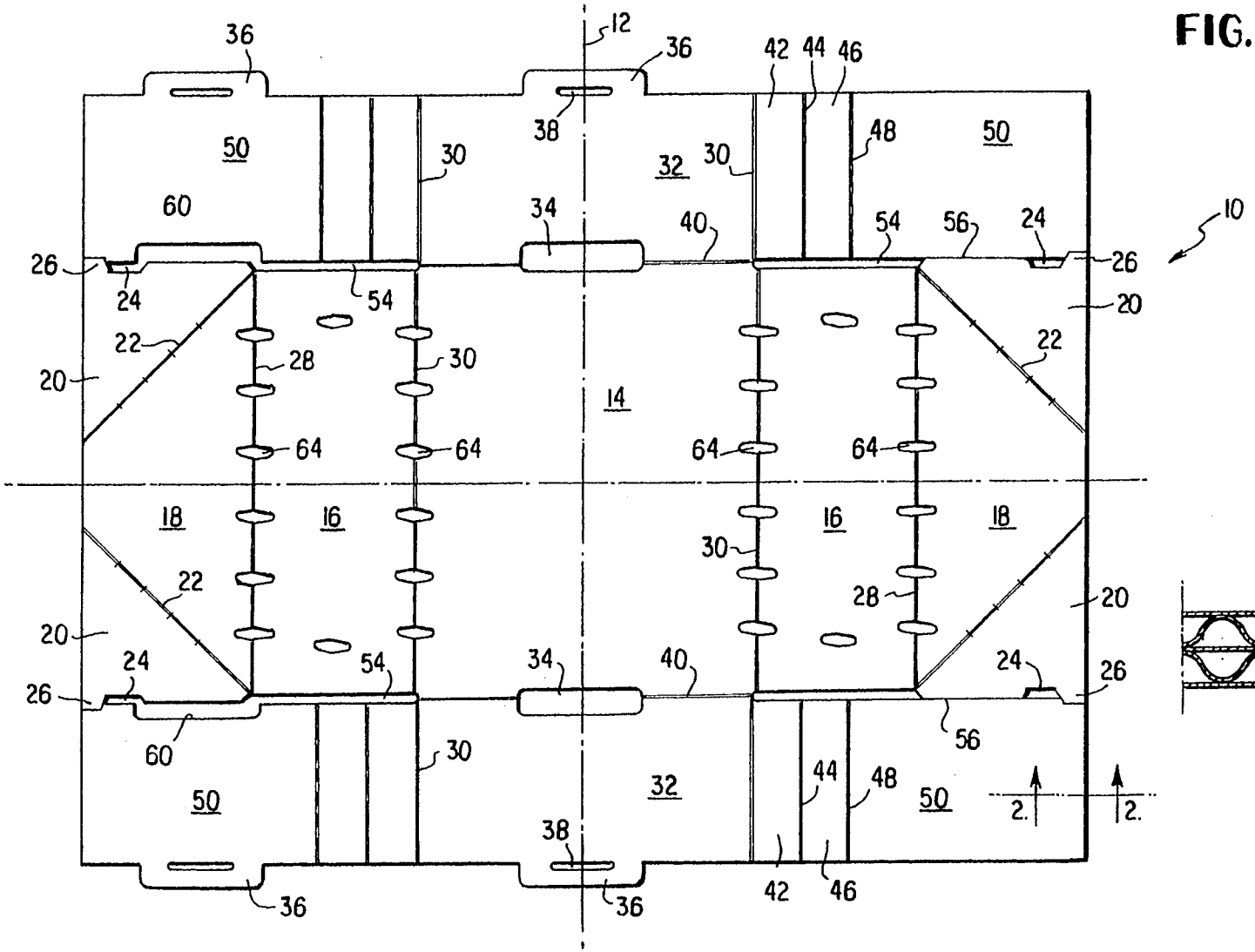
FIG. 1 is a plan view of a unitary blank of corrugated paperboard from which the container of this invention is fashioned.

Referring now to FIG. 1 of the drawings, a unitary blank of corrugated paperboard, typically of single or double thickness, is denoted generally as 10 is die cut and scored so as to be foldable into a container, the blank having a central vertical axis denoted as 12. The blank includes a bottom panel 14, two laterally positioned side panels 16 and top panels 18. Top panels 18 each carry integral portions 20 defined by slanted fold lines 22, these fold lines producing somewhat weakened areas therealong in each of panels 18. The free edges of top panels 18, at their upper and lower extremes, each carry a latching tab or tongue 26, the latter adjacent a respective recess 24 in a respective free edge of panels 18. The tips of each latching tab 26 extend beyond the top and bottom horizontal edges of top panels 18. It will be observed that each top panel 18 has three free edges, two being horizontal and one being vertical, while each side panel 16 has two free edges, both horizontal, i.e., edges which are not connected to any other panel.

Upper and lower end panels 32 are each foldably connected to the top and bottom edges of bottom panel 14, with generally narrow rectangular openings 34 spanning the junction of end panels 32 and bottom panel 14 along score lines 40. Each end panel 32 carries, along its free edge, a protruding ear 36 having a generally rectangular opening 38, with ears 36 termed apertured ears. The vertically extending edges of end panels 32 are each foldably connected along scores 30 to a respective end reinforcing panel 50, with sections 42 and 46 of each end reinforcing panel defined by vertically extending score lines 30, 44 and 48.

Vertically extending score lines 28 foldably connect panels 16 to panels 18, while vertically extending score lines 30 foldably connect panels 16 and 14. Slots 54 separate the upper and lower edges of side panels 16 from respective inner free edges of end reinforcing panels 50, while to the right of axis 12 cut or slit 56 separate the inner free edges of end reinforcing panels from top panel 18. .Relief recesses 60 on the left of axis 12 separate the remaining portions of end reinforcing panels 50 from respective top panel 18. Apertured ears 36, each having a generally rectangular opening 38, are located on the uppermost and lower most free edges of those two vertically aligned and reinforcing panels 50 to the left of axis 12. Ventilation openings 64 are provided located at spaced positions along fold lines 28 and 30. Except for relief recesses 60 and left apertured ears 36, blank 10 is mirror symmetrical about axis 12.

Figure 2:
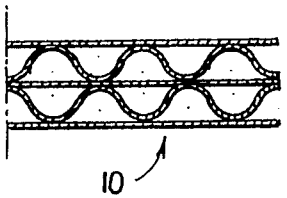
FIG. 2 is taken along section 2—2 of FIG. 1.

FIG. 2 is a sectional view of a portion of the blank of FIG. 1 taken along section 2—2 and illustrates that, optionally, the blank may be formed from a double wall thickness of corrugated paperboard. Single wall thickness of corrugated paperboard, not illustrated but well known, may also be employed.

Referring now to FIG. 3 of the drawings, the carton is shown from the top in its erected configuration, but with the top closure panels 18 open or folded outward. Left hand end reinforcement panels 50, referring to FIG. 1, have been bent around their respective fold lines 30 which couple them to end panels 32 and are glued to the interior forming surfaces of end panels 32. Next, the right hand end reinforcement panels 50, referring to FIG. 1, are bent around their respective fold lines 30 and glued to the left end reinforcements 50. The manner of folding the end reinforce panels 50 onto end panels 32 and onto themselves is such that sections 42 and 46 of each of the four end reinforcement panels 50 form vertically extending columns 47, generally triangular in transverse cross section as may be seen at FIG. 3. After the end reinforcing panels 50 have been folded and glued in the manner described, end panels 32 are folded to a vertical position about scores 40, and side panels 16 are folded vertically upwardly about scores 30 and are glued to respective sections 42 of each of the vertically extending columns 47. Thus, as shown at FIG. 3, there are four respective areas of glue which attach side panels 16 to sections 42 of respective end reinforcing panels 50.

Turning now to FIG. 4 of the drawings, being a vertical section taken midway of the container along 4—4 FIG. 3, it is seen that each of end panels 32 forms an outer side surface of the container and is laminated to those end reinforcing panels 50 which have ears 36, thus forming a double thickness of the sheet material for each of the final upstanding ears. The innermost of reinforcing panels 50 at each end wall is not provided with an upstanding and apertured ear 36, and these are the innermost portions of the composite laminate at each end wall of the container. The relationship between openings 34 and recesses 60 is clearly seen at FIG. 4. The reader will readily visualize that by virtue of these elements, upstanding ears 36 of a lower container are received in these lower openings 34, 60 at the right and left lower edges. This provides a stacking capability of the container. As indicated by the dashed line denoting top closures 18, these top panels or top closures extend such that their respective tabs 26 fit into and engage respective pairs of openings 38 of ears 36, as is also shown at FIGS. 5 and 6.

Figure 5:
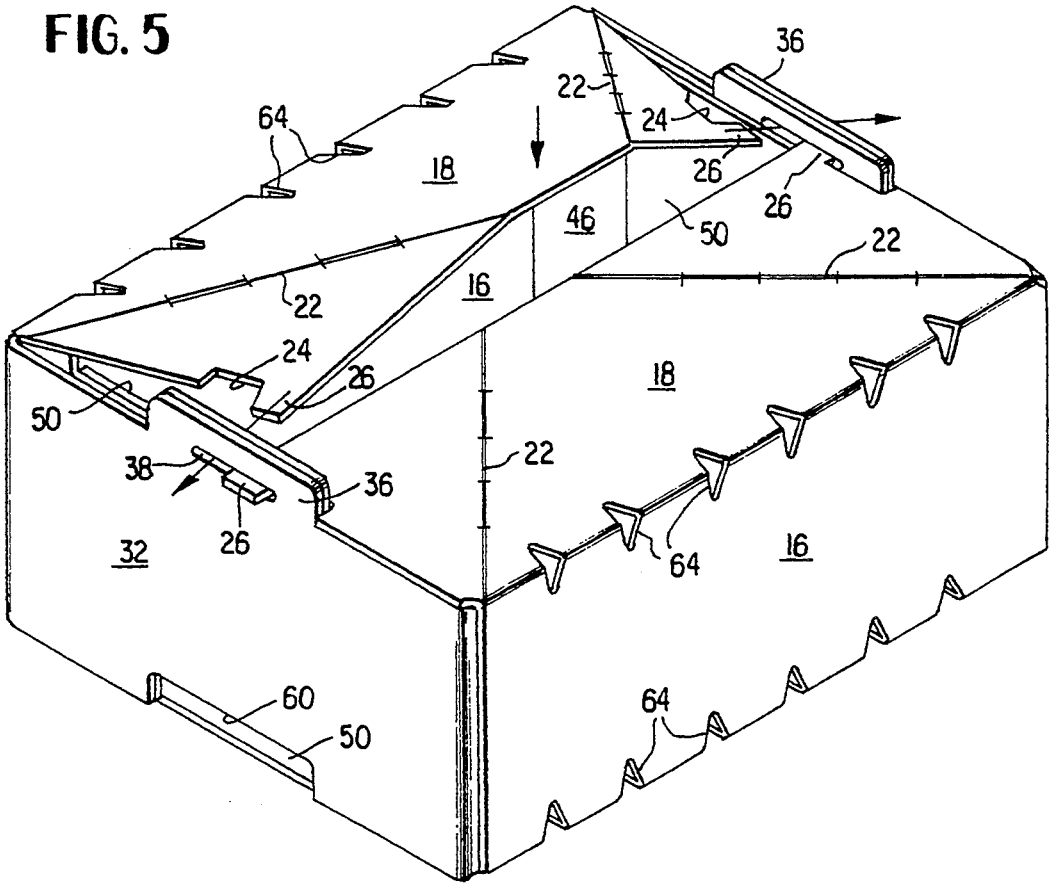
FIG. 5 is a perspective view showing the container nearly closed.
Figure 6:
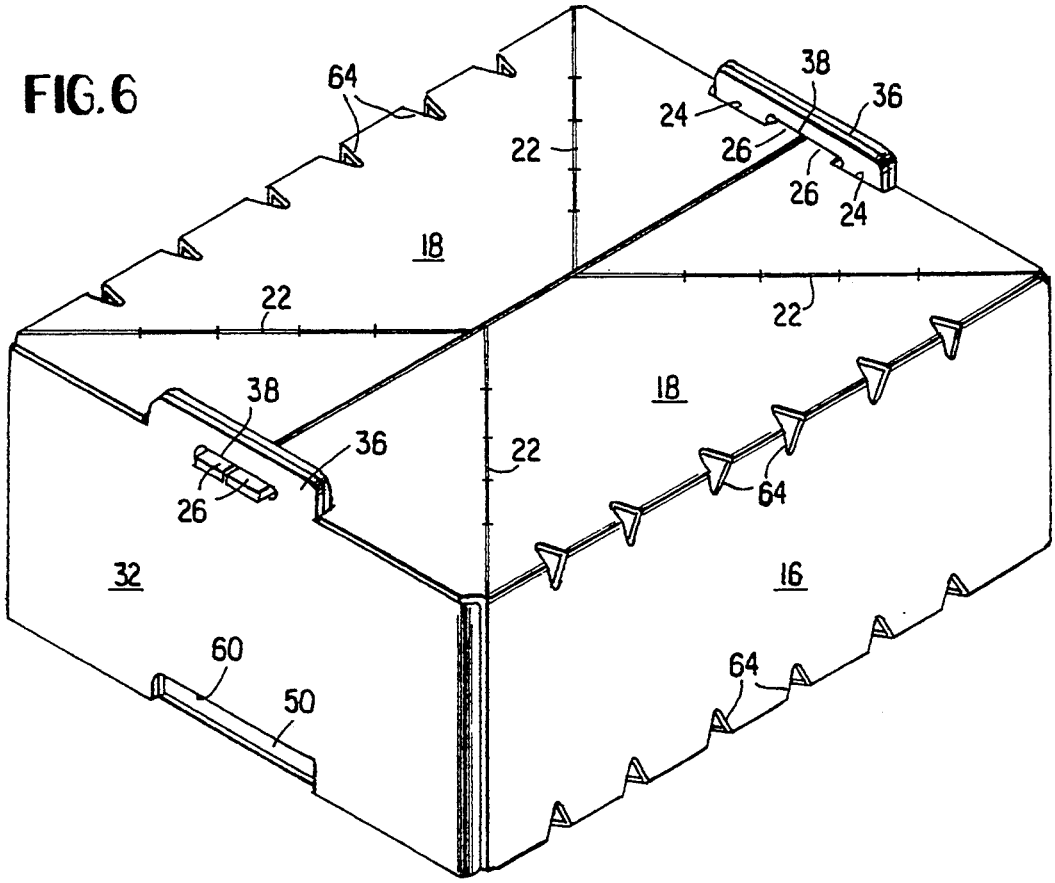
FIG. 6 is a perspective view showing the container fully closed.

Referring now to FIG. 5, one of the two panels top 18 is completely in place, with the other top panel being manually bent, along weakened portions 22 so as to diminish the distance between latching tabs or tongues 26 and thus permit their insertion into spaced apart slot pairs 38. At FIG. 6, this second top panel 18 has been pushed completely down to permit tongues 26 to enter respective slot pairs 38 and this second top panel 18 is now flat and fully engaged with respective slot pairs 38. This procedure is used for both top panels. FIGS. 5 and 6 again show the recesses defined by openings 34 and 60 to permit the upstanding ears of a lower container to fit into them. FIGS. 5 and 6 also show the innermost of the end closure panels 50 through the openings defined by 34 and 60. FIGS. 5 and 6 further show the purpose of recesses 24. These recesses are wide enough to permit respective tongues 26 to make a full entry into respective slot pairs 38, and to extend beyond them by receiving respective halves to upstanding ear pairs 36.

As noted above, the two end reinforcement panels 50 at each end wall are overlapped on the inside surface of respective end panels 32 to yield end walls of three thicknesses of the sheet material, corrugated board. This arrangement provides excellent stacking strength to the container, along with vertically extending columns 47.

Geometrical terms of orientation such as upper, right and the like are used to facilitate the description and are not intended as terms of limitation.

I claim:

1. A rectangular parallelepiped container formed of a unitary blank of scored and cut corrugated paperboard and having interior surfaces, the container having a bottom panel, two opposite side panels connected to said bottom panel, two top panels each connected to a respective said side panel, two opposite end panels each connected to said bottom panel, said two opposite end panels each connected to a respective end wall reinforcing panel by a first end wall reinforcing panel section extending parallel to and in contact with a respective side panel and a second end wall reinforcing panel section extending back and into surface contact with said end wall reinforcing panel to thereby form hollow columns at interior corners of the container, said end wall reinforcing panels being overlapped on respective container interior facing surfaces of respective end panels to thereby form respective end walls, said end walls each having an area and each said end wall having three thicknesses of said corrugated paperboard along the major portion of said area of each of said respective end walls of said container, an upstanding apertured ear on two next adjacent end wall reinforcing panels of each said end wall to thereby define a pair of apertured, upstanding ears extending above each end wall, a latching tab along opposite edges of each said top panel and extending into respective apertured ears.

2. The container of claim 1 including a recess at the junction of each of said end panels and said bottom panel.

3. The container of claim 1 wherein said hollow columns are generally triangular in cross section.

4. The container of claim 1 wherein said end walls have said three thicknesses of said corrugated paperboard over substantially their entire area except for that end wall area occupied by said hollow columns.

5. The container of claim 1 wherein said end walls have said three thicknesses of said corrugated paperboard over their entire area except for that end wall area occupied by said hollow columns, and wherein said three thicknesses of corrugated paperboard are parallel to each other.

6. The container of claim 4 wherein said three thicknesses of corrugated paperboard are glued together.

7. The container of claim 3 wherein said end walls have said three thicknesses of said corrugated paperboard over substantially their entire area except for that end wall area occupied by said hollow columns.

8. The container of claim 3 wherein said end walls have said three thicknesses of said corrugated paperboard over their entire area except for that end wall area occupied by said hollow columns, and wherein said three thicknesses of corrugated paperboard are parallel to each other.

9. The container of claim 3 wherein said three thicknesses of corrugated paperboard are glued together.

* * * * *